US009764585B2

(12) United States Patent
Meadows

(10) Patent No.: US 9,764,585 B2
(45) Date of Patent: Sep. 19, 2017

(54) DOCUMENT STORAGE ASSEMBLY

(71) Applicant: Garrett Meadows, Moorpark, CA (US)

(72) Inventor: Garrett Meadows, Moorpark, CA (US)

( * ) Notice: Subject to any disclaimer, the term of this patent is extended or adjusted under 35 U.S.C. 154(b) by 0 days.

(21) Appl. No.: 14/974,967

(22) Filed: Dec. 18, 2015

(65) Prior Publication Data

US 2017/0173991 A1 Jun. 22, 2017

(51) Int. Cl.

| | |
|---|---|
| ***B42F 7/02*** | (2006.01) |
| ***B65D 43/16*** | (2006.01) |
| ***B65D 25/54*** | (2006.01) |
| ***B65D 25/28*** | (2006.01) |
| ***B65D 51/26*** | (2006.01) |

(52) U.S. Cl.

CPC ..... *B42F 7/025* (2013.01); *B65D 25/287* (2013.01); *B65D 25/54* (2013.01); *B65D 43/16* (2013.01); *B65D 51/26* (2013.01)

(58) Field of Classification Search

CPC . A47G 1/00; A47G 1/06; A47G 1/065; A47G 1/12; B42F 13/00; B42F 7/025; B65D 25/287; B65D 25/54; B65D 43/16; B65D 51/26; B65D 81/24; B65D 81/26

USPC ..... 206/223, 232, 449–456, 467–475, 524.8; 40/124.06, 661, 700–799

See application file for complete search history.

(56) References Cited

U.S. PATENT DOCUMENTS

D243,974 S 4/1977 Tracy
4,129,212 A * 12/1978 Hopkins ..... B42D 1/08 206/450
D253,438 S 11/1979 Markley
4,518,275 A * 5/1985 Rauch, III ..... B42F 5/005 206/472
4,596,329 A * 6/1986 Eldridge, Jr. ..... A61B 50/362 206/232
4,712,820 A 12/1987 Cartledge
4,829,691 A * 5/1989 Manjos ..... G09F 3/18 40/661
5,353,925 A * 10/1994 Lennen ..... B65D 81/266 206/424
5,462,167 A * 10/1995 Polinski ..... B42F 7/10 206/449
5,787,625 A * 8/1998 Yesbick ..... G09F 15/0006 40/712
D397,721 S 9/1998 Guyer et al.
5,984,091 A * 11/1999 Orr ..... B42D 15/045 206/232
D469,254 S 1/2003 Johnson
6,805,237 B2 * 10/2004 Curry ..... A45C 11/36 206/472
7,931,165 B2 4/2011 Croy
(Continued)

*Primary Examiner* — Bryon Gehman

(57) ABSTRACT

A document storage assembly includes a case that may contain a document. The case is substantially comprised of a translucent material such that the document may be viewed while the document is within the case. The case comprising a first half hingedly coupled to a second half. The case is positioned in an open position such that the document may be positioned between the first half and the second half. The case is sealed when the case is positioned in a closed position such that the case prevents moisture from contacting the document. A gasket is coupled to the first half thereby facilitating the case to be sealed when the case is positioned in the closed position.

10 Claims, 4 Drawing Sheets

(56) References Cited

U.S. PATENT DOCUMENTS

| | | | | |
|---|---|---|---|---|
| 8,011,510 | B1 * | 9/2011 | Smith, II | B65D 43/162 206/449 |
| D647,969 | S | 11/2011 | Shamoon | |
| 8,813,404 | B2 * | 8/2014 | Goppion | A47F 3/005 312/225 |
| 2008/0131194 | A1 * | 6/2008 | Williams | B42D 3/045 402/73 |
| 2010/0320100 | A1 * | 12/2010 | Holden | A45F 3/14 206/232 |
| 2014/0050517 | A1 * | 2/2014 | Williams | B42F 23/00 402/60 |

* cited by examiner

DOCUMENT STORAGE ASSEMBLY

BACKGROUND OF THE DISCLOSURE

Field of the Disclosure

The disclosure relates to storage devices and more particularly pertains to a new storage device for viewably storing a document while protecting the document from moisture.

SUMMARY OF THE DISCLOSURE

An embodiment of the disclosure meets the needs presented above by generally comprising a case that may contain a document. The case is substantially comprised of a translucent material such that the document may be viewed while the document is within the case. The case comprising a first half hingedly coupled to a second half. The case is positioned in an open position such that the document may be positioned between the first half and the second half. The case is sealed when the case is positioned in a closed position such that the case prevents moisture from contacting the document. A gasket is coupled to the first half thereby facilitating the case to be sealed when the case is positioned in the closed position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
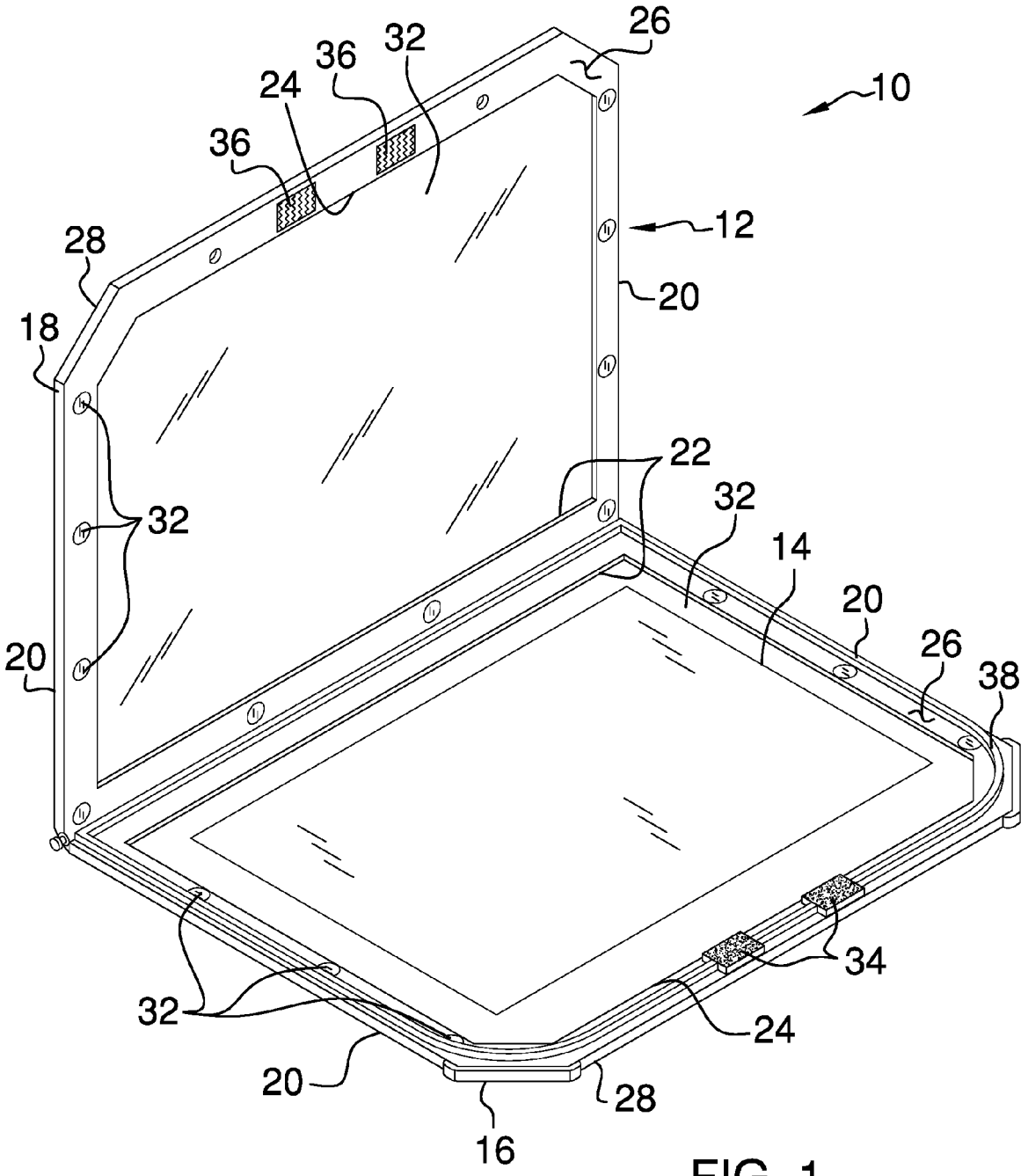
FIG. 1 is a top perspective view of a document storage assembly according to an embodiment of the disclosure.
Figure 2:
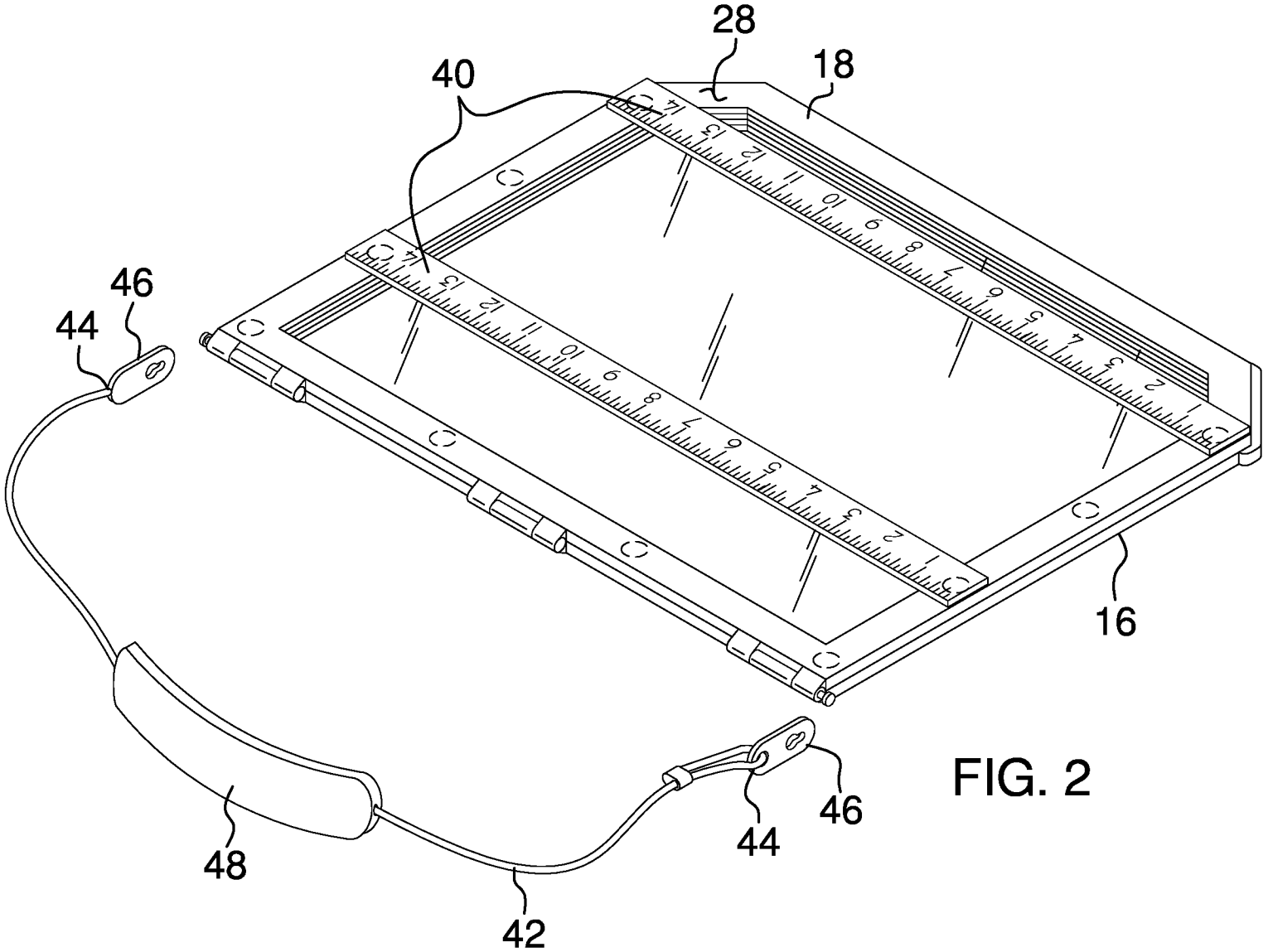
FIG. 2 is a bottom perspective view of an embodiment of the disclosure.
Figure 3:
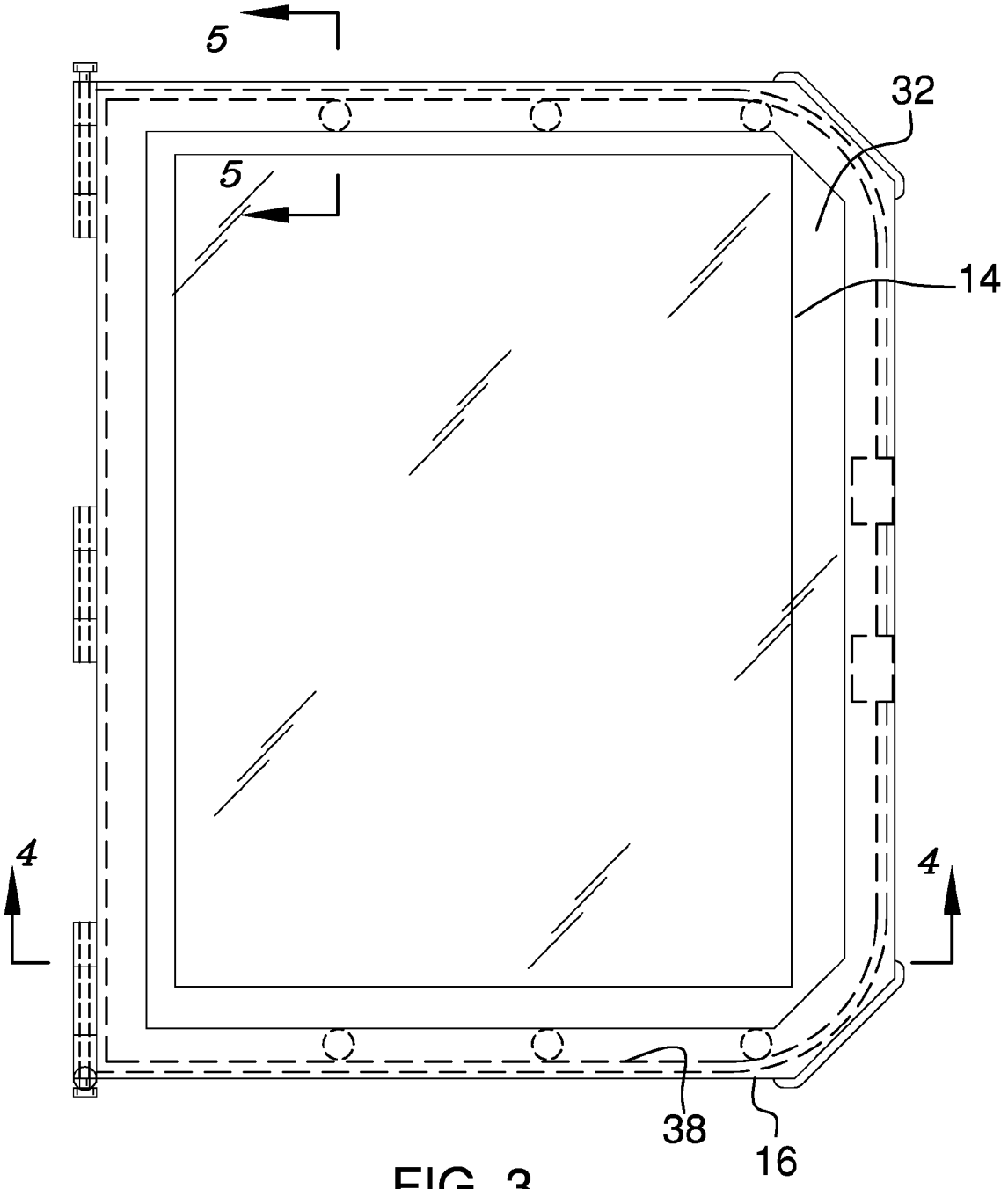
FIG. 3 is a top view of an embodiment of the disclosure.
Figure 4:
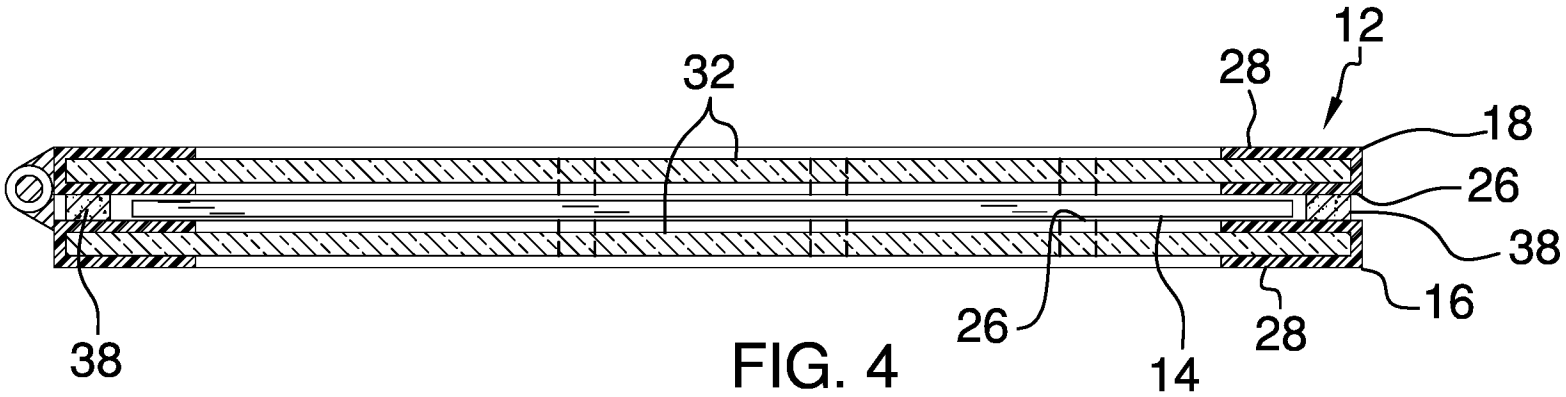
FIG. 4 is a cross sectional view taken along line 4-4 of FIG. 3 of an embodiment of the disclosure.
Figure 5:
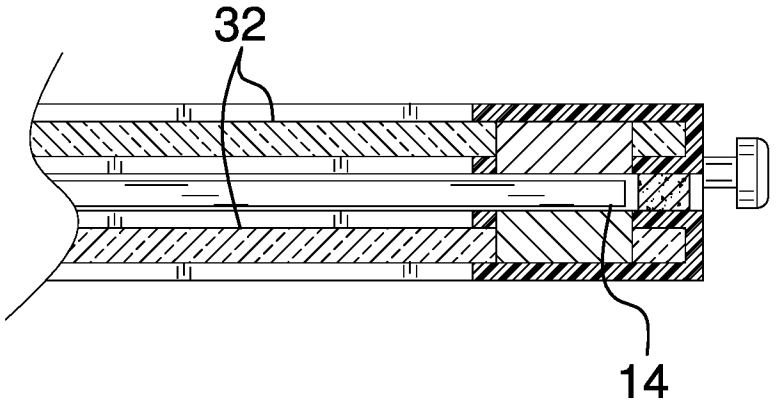
FIG. 5 is a cross sectional view taken along line 5-5 of FIG. 3 of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the document storage assembly 10 generally comprises a case 12 that may contain a document 14. The case 12 is substantially comprised of a translucent material. Thus, the document 14 is visible while the document 14 is within the case 12. The case 12 is sealed when the case 12 is positioned in a closed position. Thus, the case 12 prevents moisture from contacting the document 14 while the document 14 is within the case 12.

The case 12 comprises a first half 16 that is hingedly coupled to a second half 18. Each of the first half 16 and the second half 18 comprise a pair of longitudinal arms 20 extending between a first lateral arm 22 and a second lateral arm 24. The longitudinal arms 20 are spaced apart from each other such that each of the first half 16 and the second half 18 has a rectangular shape. The first lateral arm 22 corresponding to the first half 16 is hingedly coupled to the first lateral arm 22 corresponding to the second half 18. Each of the longitudinal arms 20, the first lateral arm 22 and the second lateral arm 24 has an inwardly facing surface 26 and an outwardly facing surface 28. Each of the longitudinal arms 20, the first lateral arm 22 and the second lateral arm 24 corresponding to each of the first half 16 and the second half 18 may be comprised of a resiliently compressible material such as rubber or the like.

Each of the first half 16 and the second half 18 includes a window 30 that extends between the pair of longitudinal arms 20, the first lateral arm 22 and the second lateral arm 24. The window 30 is comprised of a translucent material such that the document 14 is visible through the window 30 and the translucent material may be transparent. Each of the first half 16 and the second half 18 includes a plurality of magnets 32. Each of the magnets 32 is embedded within the inwardly facing surface 26. The magnets 32 are spaced apart from each other and are distributed around the pair of longitudinal arms 20, the first lateral arm 22 and the second lateral arm 24.

The case 12 is positionable in an open position such that the document 14 may be positioned between the first half 16 and the second half 18. The inwardly facing surface 26 corresponding to the first half 16 is aligned with the inwardly facing surface 26 corresponding to the second half 18 when the case 12 is positioned in the closed position. The document 14 is visible through the window 30 corresponding to the first half 16 and the second half 18. The magnets 32 corresponding to the first half 16 are complementary with respect to the magnets 32 corresponding to the second half 18 such that case 12 is magnetically retained in the closed position.

A first set of fasteners 34 is provided and each of the first set of fasteners 34 is coupled to the second lateral arm 24 corresponding to the first half 16. Each of the first set of fasteners 34 is positioned on the inwardly facing surface 26 corresponding to the first half 16. A second set of fasteners 36 is provided and each of the second set of fasteners 36 is coupled to the second lateral arm 24 corresponding to the second half 18. Each of the second set of fasteners 36 is positioned on the inwardly facing surface 26 corresponding to the second half 18. The first set of fasteners 34 is complementary with respect to the second set of fasteners 36. The first set of fasteners 34 and the second set of fasteners 36 may comprise a hook and loop fastener or the like.

A gasket 38 is coupled to the first half 16. The gasket 38 is positioned on the inwardly facing surface 26 corresponding to the first half 16. The gasket 38 extends along each of the longitudinal arms 20, the first lateral arm 22 and the second lateral arm 24 corresponding to the first half 16. The inwardly facing surface 26 corresponding to the second half 18 abuts the gasket 38 when the case 12 is positioned in the closed position. Thus, the gasket 38 forms a fluid impermeable seal with the case 12 when the case 12 is positioned in the closed position.

A pair of rulers 40 is provided and each of the rulers 40 is removably coupled to the outwardly facing surface 28 corresponding to the second half 18. Each of the rulers 40 is comprised of a magnetically attractive material. Thus, the magnets 32 corresponding to the second half 18 removably retain each of the rulers 40 on the second half 18. Each of the rulers 40 may retain the additional document 14 on the outwardly facing surface 28 corresponding to the second half 18.

A cord 42 is provided that has a pair of ends 44 and each of the ends 44 has an associated one of a pair of couplers 46 attached thereto. Each of the couplers 46 engages opposite ends of the first lateral arm 24 corresponding to the second half 18. Thus, the cord 42 is removably coupled to the case 12 and the cord 42 may support the case 12 from a user. A pad 48 is attached to the cord and the pad 48 is centrally positioned between the couplers 46 such that the pad 48 may enhance a comfort of the cord 42.

In use, the case 12 is positioned in the open position and the document 14 is placed on a selected one of the first half 16 or the second half 18. The case 12 is placed in the closed position and the document 14 is viewed through the window 30 of each of the first half 16 and the second half 18. The case 12 is used outdoors such that the document 14 is visible and the document 14 is protected from the elements. Each of the rulers 40 may secure the additional document 14 to the outwardly facing surface 28 of the second half 18.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A document storage assembly comprising:

a case being configured to contain a document, said case being substantially comprised of a translucent material wherein said case is configured to allow the document to be viewed while the document is within said case, said case comprising a first half being hingedly coupled to a second half, said case being positioned in an open position wherein said case is configured to have the document positioned between said first half and said second half, said case being sealed when said case is positioned in a closed position wherein said case is configured to prevent moisture from contacting the document; and a gasket being coupled to said first half, said second half abutting said gasket when said case is positioned in said closed position thereby facilitating said case to be sealed when said case is positioned in said closed position;

wherein each of said first half and said second half comprises a pair of longitudinal arms extending between a first lateral arm and a second lateral arm, said longitudinal arms being spaced apart from each other such that said case has a rectangular shape, said first lateral arm corresponding to said first half being hingedly coupled to said first lateral arm corresponding to said second half, each of said longitudinal arms, said first lateral arm and said second lateral arm having an inwardly facing surface and an outwardly facing surface; and a pair of rulers, each of said rulers being removably coupled to said outwardly facing surface corresponding to said second half, each of said rulers being comprised of a magnetically attractive material such that said magnets corresponding to said second half removably retains each of said rulers on said second half wherein each of said rulers is configured to retain a document on said outwardly facing surface corresponding to said second half.

2. The assembly according to claim 1, wherein each of said first half and said second half further comprises a respective window extending between said pair of longitudinal arms, said first lateral arm and said second lateral arm, said window being comprised of a translucent material.

3. The assembly according to claim 2, wherein said inwardly facing surface corresponding to said first half being aligned with said inwardly facing corresponding to said second half when said case is positioned in said closed position thereby facilitating the document to be visible through said respective window corresponding to said first half and said second half.

4. The assembly according to claim 1, wherein each of said first half and said second half further comprises a plurality of magnets, each of said magnets being embedded within said inwardly facing surface, said magnets being spaced apart from each other and being distributed around said pair of longitudinal arms, said first lateral arm and said second lateral arm.

5. The assembly according to claim 4, wherein said magnets corresponding to said first half being complementary with respect to said magnets corresponding to said second half such that case is magnetically retained in said closed position.

6. The assembly according to claim 1, further comprising a first set of fasteners, each of said first set of fasteners being coupled to said second lateral arm corresponding to said first half, each of said first fasteners being positioned on said inwardly facing surface corresponding to said first half.

7. The assembly according to claim 6, further comprising a second set of fasteners, each of said second set of fasteners being coupled to said second lateral arm corresponding to said second half, each of said second fasteners being positioned on said inwardly facing surface corresponding to said second half, said first set of fasteners being complementary with respect to said second set of fasteners.

8. The assembly according to claim 1, wherein said gasket is positioned on said inwardly facing surface corresponding to said first half, said gasket extending along each of said longitudinal arms, said first lateral arm and said second lateral arm corresponding to said first half.

9. The assembly according to claim 1, further comprising a cord having a pair of ends, each of said ends having an associated one of a pair of couplers being attached thereto, each of said couplers engaging opposite ends of said first lateral arm corresponding to said second half such that said cord is removably coupled to said case wherein said cord is configured to support said case from a user, said cord having a pad being centrally positioned between said couplers wherein said pad is configured to enhance a comfort of said cord.

10. A document storage assembly comprising:

a case being configured to contain a document, said case being substantially comprised of a translucent material wherein said case is configured to allow the document to be viewed while the document is within said case, said case being sealed when said case is positioned in a closed position wherein said case is configured to prevent moisture from contacting the document, said case comprising a first half being hingedly coupled to a second half, each of said first half and said second half comprising:

a pair of longitudinal arms extending between a first lateral arm and a second lateral arm, said longitudinal arms being spaced apart from each other such that said case has a rectangular shape, said first lateral arm corresponding to said first half being hingedly coupled to said first lateral arm corresponding to said second half, each of said longitudinal arms, said first lateral arm and said second lateral arm having an inwardly facing surface and an outwardly facing surface, a respective window extending between said pair of longitudinal arms, said first lateral arm and said second lateral arm, said window being comprised of said translucent material, and a plurality of magnets, each of said magnets being embedded within said inwardly facing surface, said magnets being spaced apart from each other and being distributed around said pair of longitudinal arms, said first lateral arm and said second lateral arm;

said case being positionable in an open position wherein said case is configured to have the document positioned between said first half and said second half, said inwardly facing surface corresponding to said first half being aligned with said inwardly facing corresponding to said second half when said case is positioned in said closed position thereby facilitating the document to be visible through said respective window corresponding to said first half and said second half, said magnets corresponding to said first half being complementary with respect to said magnets corresponding to said second half such that case is magnetically retained in said closed position;

a first set of fasteners, each of said first set of fasteners being coupled to said second lateral arm corresponding to said first half, each of said first fasteners being positioned on said inwardly facing surface corresponding to said first half;

a second set of fasteners, each of said second set of fasteners being coupled to said second lateral arm corresponding to said second half, each of said second fasteners being positioned on said inwardly facing surface corresponding to said second half, said first set of fasteners being complementary with respect to said second set of fasteners;

a gasket being coupled to said first half, said gasket being positioned on said inwardly facing surface corresponding to said first half, said gasket extending along each of said longitudinal arms, said first lateral arm and said second lateral arm corresponding to said first half, said inwardly facing surface corresponding to said second half abutting said gasket when said case is positioned in said closed position thereby facilitating said case to be sealed when said case is positioned in said closed position;

a pair of rulers, each of said rulers being removably coupled to said outwardly facing surface corresponding to said second half, each of said rulers being comprised of a magnetically attractive material such that said magnets corresponding to said second half removably retains each of said rulers on said second half wherein each of said rulers is configured to retain a document on said outwardly facing surface corresponding to said second half; and a cord having a pair of ends, each of said ends having an associated one of a pair of couplers being attached thereto, each of said couplers engaging opposite ends of said first lateral arm corresponding to said second half such that said cord is removably coupled to said case wherein said cord is configured to support said case from a user, said cord having a pad being centrally positioned between said couplers wherein said pad is configured to enhance a comfort of said cord.

* * * * *